US006019325A

United States Patent [19]

Dotson et al.

[11] Patent Number: 6,019,325

[45] Date of Patent: Feb. 1, 2000

[54] PORTABLE DEPTH-FINDER DISPLAY SUPPORT

[76] Inventors: Kennith L. Dotson, 264 Crest St.; Kenneth E. Blevins, 218 W. Rio Blanco, both of Rangely, Colo. 81648

[21] Appl. No.: 09/100,937

[22] Filed: Jun. 22, 1998

[51] Int. Cl.[7] ..... F16L 3/00

[52] U.S. Cl. ..... 248/121; 248/146; 248/219.2; 248/635

[58] Field of Search ..... 248/146, 219.2, 248/154, 121, 156, 534, 519, 530, 632, 635

[56] References Cited

U.S. PATENT DOCUMENTS 2,894,263 7/1959 Kunkel ..... 248/534 X
4,496,123 1/1985 Laramie ..... 248/121
4,901,913 2/1990 Fischer ..... 232/17
5,362,019 11/1994 Swanson ..... 248/146

*Primary Examiner*—Leslie A. Braun
*Assistant Examiner*—Gwendolyn Baxter
*Attorney, Agent, or Firm*—Richard C. Litman

[57] ABSTRACT

A portable depth-finder display support consisting of a cylindrical flexible bushing base, a tubular shaft and a mounting plate. The bushing base is sized to fit within the confines of a standard-sized cup holder such as those found molded into the deck structures of many recreational motor boats. One end of the tubular shaft is fitted into a substantially centered hole in the bushing base. The mounting plate is fixed atop the other end of the tubular shaft. The mounting plate has a plurality of circular openings specifically configured to accommodate the manufacturer supplied mounting brackets of many commercially available depth-finders.

12 Claims, 2 Drawing Sheets

PORTABLE DEPTH-FINDER DISPLAY SUPPORT

BACKGROUND OF THE INVENTION

1. Field of the Invention

The present invention relates to a portable means for mounting an electronic accessory, and more particularly a supporting device for removably mounting the display panel of a boat depth-finder within an existing cylindrical receptacle, such as a beverage or cup holder.

2. Description of the Related Art

In general, easily removable mounting devices for boat depth-finders fall in two categories: (1) devices that provide for mounting both the sonar transducer and the depth finder display panel and (2) devices that are sonar transducer mounts only which hook over the upper ledge of the boat's transom.

The first type of holder, as seen in U.S. Pat. No. 5,529,272, issued to Baublitz, Sr. on Jun. 25, 1996, discloses an apparatus for holding a sonar transducer below the water level while supporting the depth-finder display panel within the boat along the perimeter of the boat's cockpit area. The Baublitz, Sr. holder consists of a tube with a means for mounting a sonar transducer to its bottom portion. The upper portion of the tube includes an open-faced box for holding the depth-finer display panel. The tube hooks onto the upper ledge of the transom of the boat by means of a boat clamp.

The second type of holder provides for a means of supporting the sonar transducer only. One such device, as described in U.S. Pat. No. 3,989,213, issued to Allen on Nov. 2, 1976, consists of a top portion which hooks over the upper ledge of the transom and is attached to a mounting post, the opposite side of which is a clamp that holds the transducer in a depth-sensing position. The entire device can be easily removed from the boat by pulling up on the attached handle.

Another such device, as shown in U.S. Pat. No. 3,752,431, issued to McBride on Aug. 14, 1973, also has a bracket at the top which hooks over the upper ledge of the transom and a bracket at the bottom to which the sonar transducer is bolted and held below the water line. This type of holder also has a crank arm to adjust the depth of the sonar transducer.

It can readily be seen that the second type of holder allows for the portability of the sonar transducer unit only. In other words, while the sonar transducer can be removably mounted to the boat's transom, no provision is made for making portable the depth-finder display panel, which is usually permanently mounted on the upper portion of the boat's steering console.

The Baublitz, Sr. device goes part way to remedying this problem by providing a single means for removably mounting both the sonar transducer and the depth-finder display panel. However, it is apparent that the single means approach of Baublitz, Sr. is limited by its own functionality. By mounting both items on a single tube, the depth-finder display panel can only be mounted, and therefore viewed, along the perimeter of the boat's cockpit (see, FIGS. 7 and 8 of Baublitz, Sr., incorporated by reference herein).

On the other hand, the mounting means of the present invention allows for placement of the device in any available cylindrical receptacle such as a cup holder. Cup holders can be found molded into deck and steering console of many recreational power boats. Accordingly, the present invention provides for a more convenient means of viewing the depth-finder display panel by placing it within the cockpit of the boat readily accessible to the normal sitting or standing positions of the occupants.

Because the present invention can be placed in a cup holder, it is also related to the field of article holders utilizing a receptacle means. The art related to receptacle-type article holders is varied. For example, U.S. Pat. No. 5,174,534, issued to Mitchell on Dec. 29, 1992, discloses an adapter for adapting a container holder to support a container, such as a beverage container, in a substantially upright position. The Mitchell adapter cooperates with a beverage container or cup-type holder having a cylindrical receptacle for supporting beverage containers of various sizes and shapes.

Additionally, U.S. Pat. No. 5,676,340 issued to Ruhnau on Oct. 14, 1997 shows an adapter for holding over-sized containers for use in cylindrical beverage receptacles, such as cup holders, found in many vehicles. The adapter has an enlarged upper portion to receive an over-sized beverage container and a lower portion comprising an insertion base sized to fit within a standard-sized vehicle cup holder.

It is apparent that the Mitchell and Ruhnau adapters are fashioned to compliment, but not expand upon, the original functionality of a cup holder. In other words, these adapters merely provide a means for mating over-sized or unusually shaped beverage containers with a standard-sized vehicle cup holder. However, creating a new use for a cup holder is not envisioned.

Multiple use holders are known in the patent literature. For example, U.S. Pat. No. 5,657,957, issued to Graham on Aug. 19, 1997, describes a golf cart accessory having an angled cylindrical fitting which can be interchangeably fitted with an umbrella mount or a beverage holder. The Graham patent device does not use a cup holder as the base receptacle for mounting an umbrella. Instead, the cylindrical fitting of Graham acts as a common receptacle for mounting various accessories.

Although Graham teaches the use of a common cylindrical receptacle for interchangeably mounting golf related accessories, it does not teach the use of an existing cup holder as a mounting base for a boating accessory such as the depth-finder display panel support of the present invention.

Accordingly, none of the above inventions and patents, taken either singularly or in combination, is seen to describe the instant invention as claimed. Thus a portable depth-finder display support solving the aforementioned problems is desired.

SUMMARY OF THE INVENTION

The present invention provides a new device for removably mounting an electronic boating accessory, such as the display panel of a depth-finder, using, as a mounting support, the cylindrical receptacle of an existing beverage container holder which can usually be found molded into the deck structure and steering console of many recreational boats.

Depth-finder display panels are typically permanently mounted to the upper surface of a boat's steering console using a mounting bracket supplied by the manufacturer. This arrangement is usually acceptable where there is adequate space for the display panel or if the user wants to view the display panel only from a steering position. On the other hand, it is often desirable to monitor the display panel from other positions within the boat at certain times such as when fishing with an electric trolling motor. In such instances, it is inconvenient to move between the boat's fishing platform and steering console to view the display panel.

Many recreational boats have cup holders molded into, or placed about, the deck structures including the boat's fishing platform area. The present invention takes advantage of the convenient placement of these cup holders by using their cylindrical receptacles as a mounting support. Accordingly, the base portion of the present invention can be inserted into any cup holder located near the user to allow for handy monitoring of the display panel.

The present invention provides a stout means for supporting a depth finder display panel or other electronic boating accessory within a boat's cockpit area in an easily viewable location. The support device consists of a cylindrical flexible bushing base, a tubular shaft and a mounting plate. The bushing base is sized to fit within the confines of a standard-sized cup holder such as those found molded into the deck structures of many recreational motor boats. One end of the tubular shaft is fitted into a substantially centered hole in the bushing base. The mounting plate is fixed atop the other end of the tubular shaft.

The mounting plate has a plurality of circular openings specifically configured to accommodate the manufacturer supplied mounting brackets of many commercially available depth-finders. As such, no special adapters are needed to fasten the display panel to the present invention's mounting plate. By employing a flexible bushing base, the support device can be removably inserted into any standard sized cup holder.

Accordingly, it is a principal object of the invention to provide a means for mounting a display panel within the cockpit area of a boat by utilizing, as base supports, existing cylindrical receptacles such as beverage or cup holders.

It is another object of the invention to provide a means for mounting a display panel that is easily removable and portable such that the mounting device can be easily repositioned to accommodate convenient monitoring by the user.

An additional object of the invention is to provide a means for mounting a display panel wherein the device accommodates a variety of manufacturer supplied display panel mounting brackets.

It is a further object of the invention to provide a means for mounting a display panel that is sturdy in construction, inexpensive to manufacture and simple to use.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
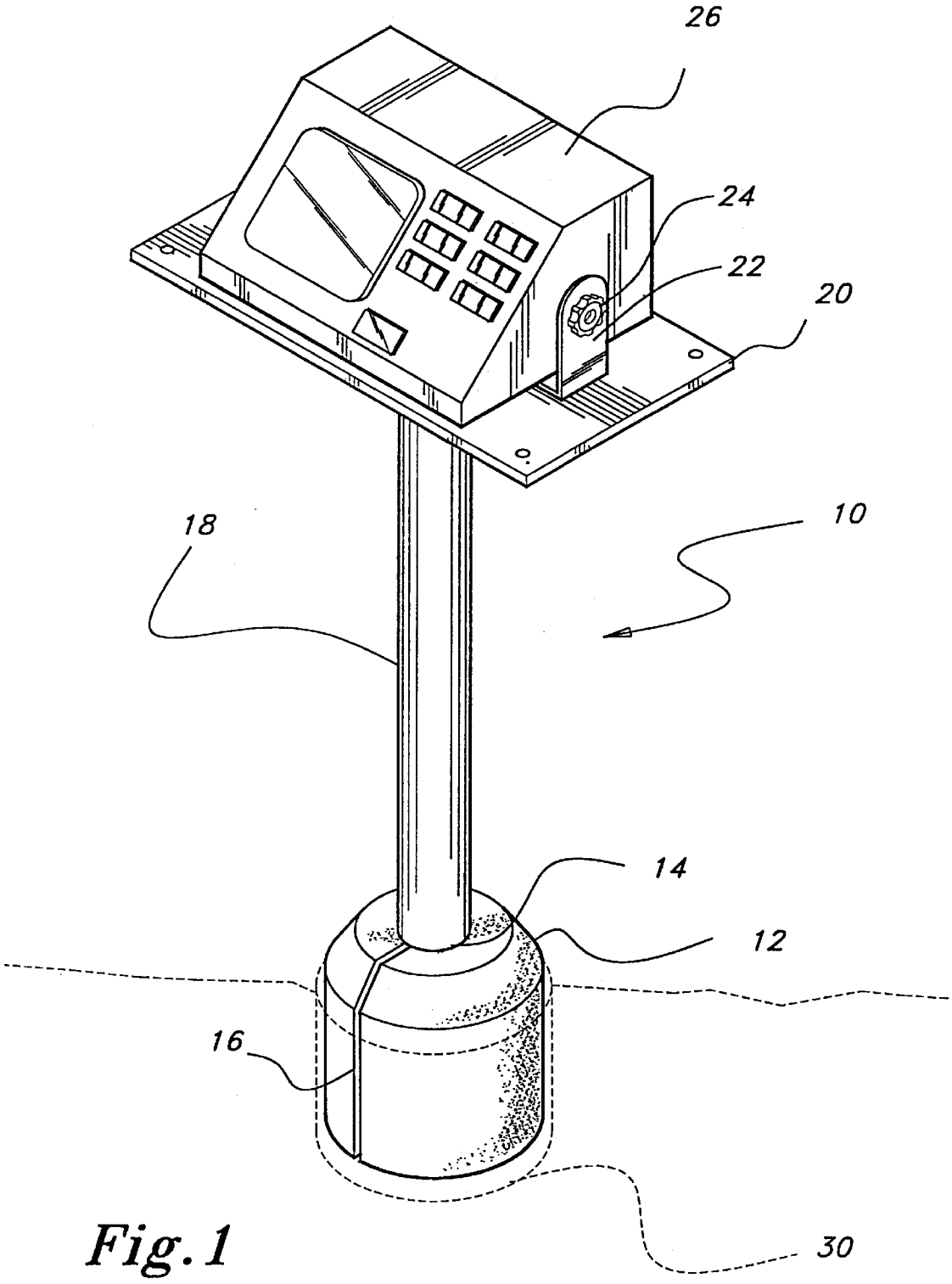
FIG. 1 is a perspective view of one embodiment of a portable depth-finder display support according to the present invention, mounted within a beverage holder.
Figure 2:
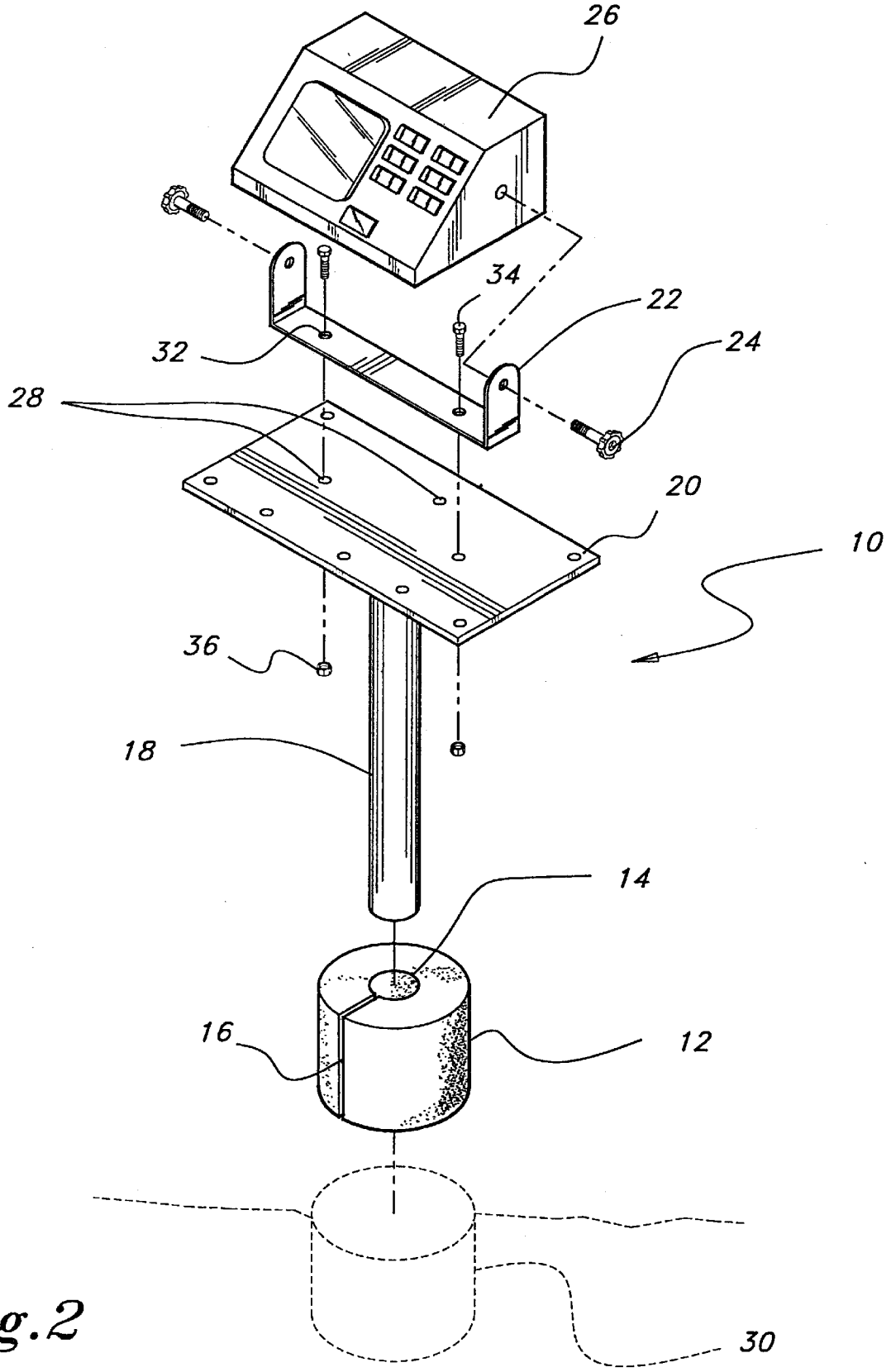
FIG. 2 is an exploded perspective view of the portable depth-finder display support of FIG. 1.

With reference first to FIG. 1, the support device of the subject invention is shown generally at 10 and comprises a bushing base 12, a tube shaft 18 and a mounting plate 20. With reference now to FIGS. 1 and 2, the individual items will be described in greater detail.

The support device 10 is shown for reference and descriptive purposes with a depth-finder display panel 26 installed using the mounting bracket 22 supplied by the manufacturer of the depth-finder. The base of the mounting bracket 22 has a plurality of cylindrical openings 32. The spacing of the cylindrical openings 32 is typically specific for each model of depth-finder produced by a manufacturer.

A mounting plate 20 is coupled atop the upper portion of the tube shaft 18. The surface of the mounting plate 20 is perpendicular to and substantially centered about the tube shaft 18. The mounting plate 20 includes a plurality of cylindrical openings 28. Cylindrical openings 28 are positioned about the mounting plate 20 such that at least two of the cylindrical openings 28 can be cooperatively profiled with cylindrical openings 32 to receive bolts 34 therethrough which are secured by nuts 36.

The bushing base, shown generally at 12, is substantially cylindrical in shape with a longitudinal axis defined along its center between both ends. The bushing base 12 is formed preferably from an elastic material such as rubber. A passage, shown as cylindrical opening 14, is provided along the longitudinal axis of the bushing base 12.

In addition, a single slit 16 is formed parallel to the longitudinal axis of the bushing base 12, from the cylindrical opening 14 to the circumference of the bushing base 12. The outside diameter and height of the bushing base 12 are such that the bushing base 12 fits within the confines of a cylindrical receptacle 30 such as beverage or cup holder. Of course, with other types of cylindrical receptacles, fishing rod holders for example, the dimensions of the bushing base 12 will differ from those described above in order to accomplish the functionality of the invention.

The inside diameter of the bushing base 12 defines the diameter of the cylindrical opening 14. The cylindrical opening 14 has a diameter smaller than the diameter of the tube shaft 18. The slit 16 is provided as a relief slit, permitting the bushing base 12 to expand for the purpose as described below.

To use the support device of the present invention, the bushing base 12 is first inserted into the appropriate cylindrical opening 30. The lower portion of the tube shaft 18 is then inserted into the cylindrical opening 14. Because the diameter of tube shaft 18 is greater than the diameter of cylindrical opening 14, insertion of the tube shaft 18 into cylindrical opening 14 causes the bushing base to expand about its circumference.

During this expansion, slit 16 in the bushing base 12 allows the outer surface of the bushing base 12 to press firmly against the wall of the cylindrical receptacle 30 to create a secure fit between the bushing base 12 and the cylindrical receptacle 30. In addition, a secure fit is also established between the lower portion of tube shaft 18 and cylindrical opening 14.

The mounting bracket 22 is then secured to the mounting plate 20 with a fastening means such as bolts 34 and nuts 36. Finally, the depth-finder display panel 26 is secured within the mounting bracket 22 using knob fasteners 24.

It is to be understood that the present invention is not limited to the embodiment described above, but encompasses any and all embodiments within the scope of the following claims.

We claim:

1. A support device for a mountable item comprising:

a bushing base, substantially cylindrical in shape, with a first end and a second end and a longitudinal axis defined therebetween, said bushing base including a relief slit along said longitudinal axis and having a passage along said longitudinal axis;

an elongated shaft with an upper portion and a lower portion and a longitudinal axis defined therebetween, wherein the lower portion of said elongated shaft is sized to be closely received by the passage of said bushing base;

a mounting plate, fixed atop the upper portion of said elongated shaft, said mounting plate having a planar surface and an attachment means for mounting an item to said planar surface, wherein the planar surface of said mounting plate is perpendicular to and substantially centered about the longitudinal axis of said elongated shaft.

2. The support device of claim 1 wherein the passage is a cylindrical opening.

3. The support device of claim 1 wherein the elongated shaft is a tubular shaft.

4. The support device of claim 1 where the attachment means comprises a plurality of cylindrical openings spaced along said mounting plate wherein at least two of said cylindrical openings are sized to accept mounting hardware.

5. The support device of claim 4 wherein said mounting hardware comprises a manufacturer supplied mounting bracket having at least two cylindrical openings which are cooperatively profiled with said cylindrical openings of said mounting plate to receive a securing means therethrough.

6. The support device of claim 5 wherein said securing means are bolts fastened by nuts.

7. The support device of claim 1 wherein said lower portion of said shaft has a diameter slightly in excess of the diameter of said passage.

8. A support device for a mountable item comprising:

a bushing base, substantially cylindrical in shape, with a first end and a second end and a longitudinal axis defined therebetween, said bushing base having a cylindrical opening along said longitudinal axis;

a tubular shaft with an upper portion and a lower portion and a longitudinal axis defined therebetween, wherein the lower portion of said tubular shaft is frictionally held by means of a relief slit along said longitudinal axis; and a mounting plate, fixed atop the upper portion of said tubular shaft, said mounting plate having a planar surface and an attachment means for mounting an item to said planar surface, wherein the planar surface of said mounting plate is perpendicular to and substantially centered about the longitudinal axis of said tubular shaft.

9. The support device of claim 8 where the attachment means comprises a plurality of cylindrical openings spaced along said mounting plate where at least two of said cylindrical openings accept mounting hardware.

10. The support device of claim 9 wherein said mounting hardware comprises a manufacturer supplied mounting bracket having at least two cylindrical openings which can be cooperatively profiled with said cylindrical openings of said mounting plate to receive a securing means therethrough.

11. The support device of claim 10 wherein said securing means are bolts fastened by nuts.

12. The support device of claim 10 wherein said lower portion has a diameter greater than the diameter of said cylindrical opening of said bushing base.

* * * * *